United States Patent [19]

Duran, Sr.

[11] 4,386,797

[45] Jun. 7, 1983

[54] DOOR KNOB LATCH APPARATUS

[76] Inventor: Joe Duran, Sr., 944 E. Renton, Carson, Calif. 90745

[21] Appl. No.: 222,703

[22] Filed: Jan. 5, 1981

[51] Int. Cl.[3] ..... E05C 19/18

[52] U.S. Cl. ..... 292/292

[58] Field of Search ..... 292/288, 289, 290, 291, 292/292, 293, 294, 295, 296, 297, 298, 299, 258

[56] References Cited

U.S. PATENT DOCUMENTS

| | | | |
|---|---|---|---|
| 603,477 | 5/1898 | Butts | 292/297 |
| 827,624 | 7/1906 | Foster | 292/288 |
| 848,644 | 4/1907 | Flegel | 292/288 |
| 866,548 | 9/1907 | Wilkinson | 292/292 |
| 936,164 | 10/1909 | Reid | 292/290 |
| 2,396,982 | 3/1946 | Bousquet | 292/289 |
| 3,316,105 | 4/1967 | Oesler | 292/296 |
| 3,416,333 | 12/1968 | Weingart | 292/292 |
| 4,004,833 | 1/1977 | Hull | 292/288 |
| 4,135,748 | 1/1979 | Roberts | 292/298 |
| 4,155,578 | 5/1979 | Rolland | 292/292 |

FOREIGN PATENT DOCUMENTS

| | | | |
|---|---|---|---|
| 2411291 | 7/1979 | France | 292/292 |
| 249032 | 3/1926 | United Kingdom | 292/298 |

*Primary Examiner*—Thomas J. Holko

*Attorney, Agent, or Firm*—Roger A. Marrs

[57] ABSTRACT

A door knob latch apparatus is disclosed herein for releasably securing a door in its closed or shut position which includes a rigid base member having a lateral tang adapted to be inserted through the bolt opening in a strike plate mounted on a door jamb. The base member includes a vertical slot opening along the top edge of the base member for slidably receiving a corresponding open-ended slot provided in a door knob latch plate so that the latch plate extends normal to the longitudinal axis of the base member. The latch plate further includes a semi-circular cut-out formed in its end opposite to its end carrying the open slot which is adapted to be placed over the door knob installation in the door itself. Therefore, when the bolt is introduced through the strike plate opening into the bolt recess in the jamb, the base member is held rigid by virtue of the tang and the latch plate is rigid by engagement with both the base member and door knob per se.

1 Claim, 3 Drawing Figures

FIG. 1
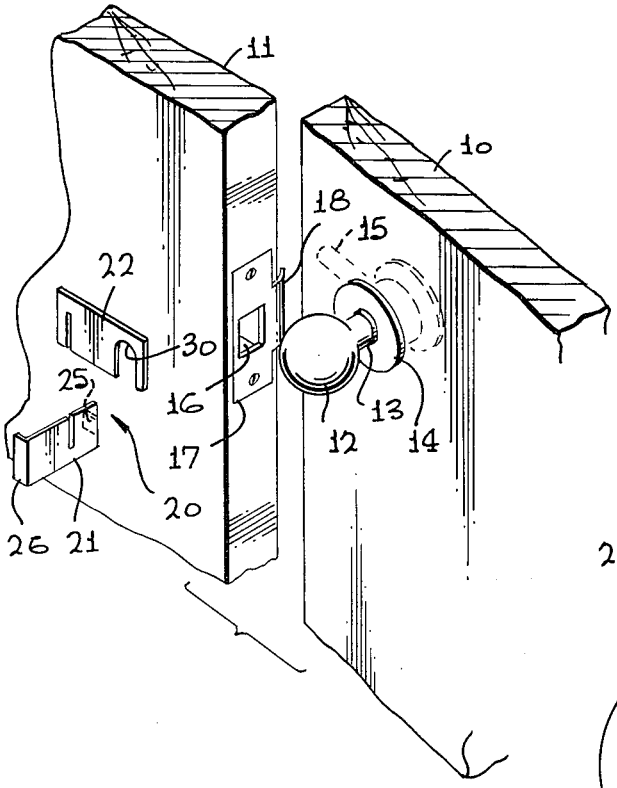
FIG. 3
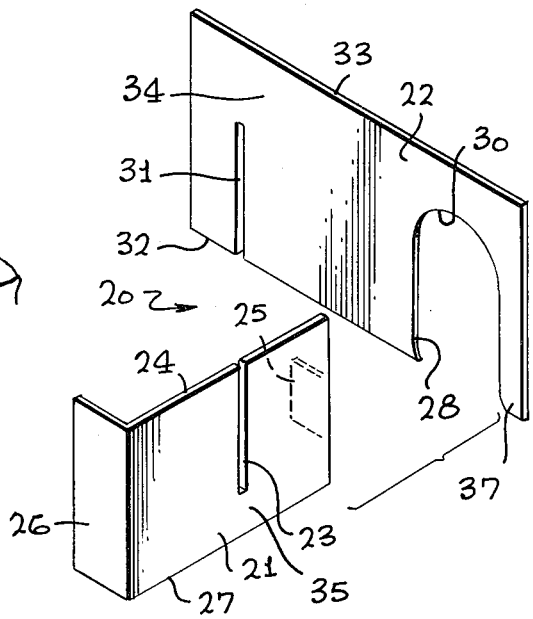
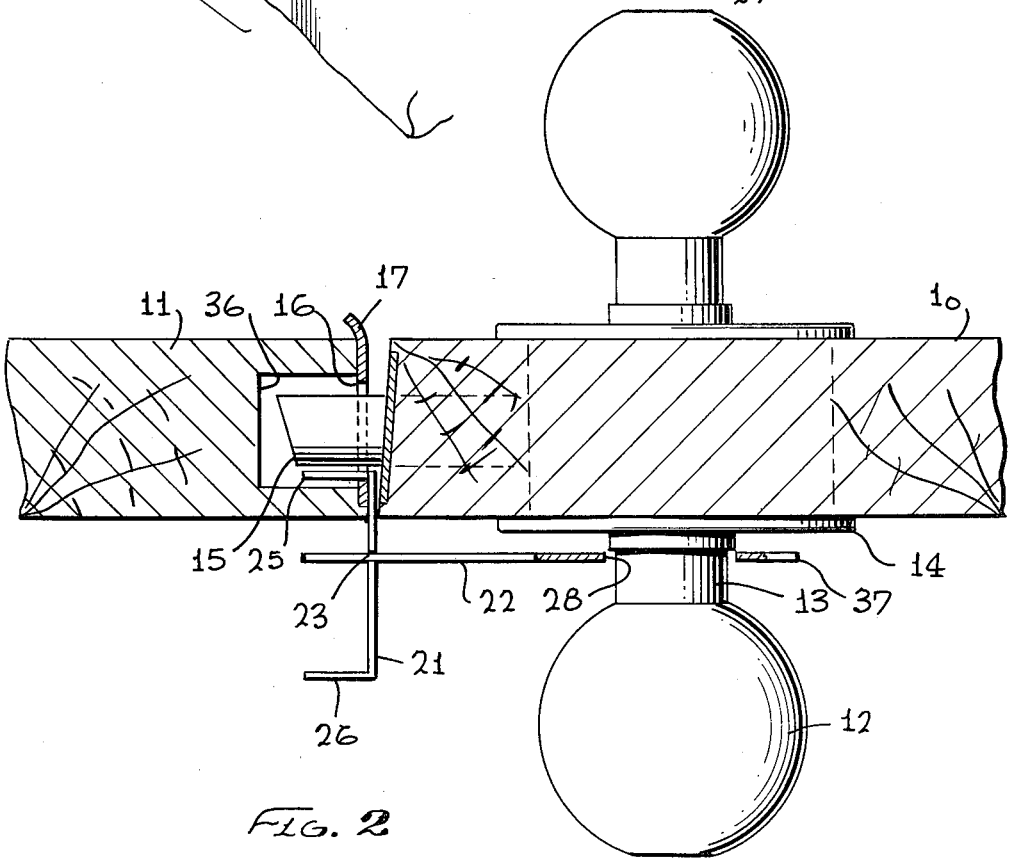
FIG. 2

DOOR KNOB LATCH APPARATUS

BACKGROUND OF THE INVENTION

1. Field of the Invention

This invention relates to door locking or latching devices and more particularly, to a novel door knob latch apparatus which is portable in nature and does not require permanent or fixed installation.

2. Brief Description of the Prior Art

In the past, it has been the conventional practice to install door locks and latching mechanisms into door jambs and the corresponding edge of a swinging door which requires such fasteners as screws, bolts, jam plates or the like. All of these prior devices are intended for fixed installation to the door jamb or the door itself and are not intended to be carried about from one place to another by the user. Also, many of the fixed installation type of locking arrangements can only be locked or opened using complicated mechanisms requiring extensive installation and many moving parts.

Furthermore, difficulties and problems have been encountered with conventional door locks which stem largely from the fact that moving mechanisms are involved which not only require lubrication but which are subject to jamming and malfunctioning of parts.

Therefore, a long standing need has existed to provide a novel door latching apparatus which may be readily carried from place to place by the user and which may be installed on a conventional door having a door knob without extensive installation requiring special tools and knowledge.

SUMMARY OF THE INVENTION

Accordingly, the above problems and difficulties are obviated by the present invention which provides a novel door latch apparatus for releasably securing a door in its closed or shut position which includes a rigid base member having an open slot extending from its top edge downwardly to terminate in fixed space relationship with respect to the lower edge and which further includes a tang laterally extending from one end of the base member which is adapted to be inserted through the bolt opening in a strike plate mounted on a door jamb. The open-ended slot on the base member slidably receives a corresponding slot provided in the lower edge of a latch plate so that the latch plate extends normal to the longitudinal axis of the base member. The latch plate includes a semicircular cut-out which is adapted to be placed over the door knob mounting shaft conventionally installed on the door.

The bolt included in the door knob installation will bear against the lateral tang when it is inserted into the door jamb bolt recess and the assembled base member and latch plate will be rigidly held in position between the engagement of the bolt with the tang and the engagement of the semi-circular cut-out with the door knob shaft.

Therefore, it is among the primary objects of the present invention to provide a novel door latch apparatus which is convenient to install without the use of special tools and equipment.

Another object of the present invention is to provide a new and simplified door latch device which may be readily carried in the pocket or purse of the user and that may be installed on a conventional door knob installation and strike plate installation without screws, fasteners or special knowledge.

Still a further object of the present invention is to provide a novel door knob latch apparatus which comprises two rigid parts engaged normal with respect to each other for releasably securing a conventional door in a closed or shut position.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings, in which:

FIG. 1 is a perspective view of a conventional door knob installation and illustrating the novel door knob latch apparatus in exploded relationship prior to installation;

FIG. 2 is an enlarged cross-sectional view of the novel door knob latch apparatus illustrated as being installed with respect to a conventional strike plate and door knob installation; and FIG. 3 is an enlarged exploded view of the base member and latch plate employed in the inventive door knob latch apparatus of the present invention.

DESCRIPTION OF PREFERRED EMBODIMENT

Referring to FIG. 1, a conventional door 10 is illustrated which is adapted to close or shut with respect to a typical door jamb 11. The door 10 includes a door knob construction having a knob 12 with a knob shaft 13 and a mounting plate 14. The mechanism of the door knob includes a bolt 15 which is adapted to pass through an opening 16 in a strike plate 17 screwed into the edge of the door jamb 11. The strike plate 17 includes a curved impact member 18 against which the bolt will strike while the door is pivoting to its shut position preparatory to the bolt entering the opening 16.

The present invention is indicated by numeral 20 and includes a rigid base member 21 which is detachably engaged with a latch plate 22. The base member 21 is associated with the striker plate 17 and the door jamb while the latch plate 22 is associated with the door knob 12 and the shaft 13 carried thereon.

Referring now in detail to FIG. 3, the door knob latching apparatus 20 is illustrated as comprising two parts, namely base member 21 and latch plate 22. The base member 21 comprises an elongated member having an open ended slot 23 formed midway between its opposite ends and opening along a top edge 24 of the member. A selected end of the plate includes a tang 25 laterally extending outwardly normal to the longitudinal axis of the plate. The width of the tang 25 is substantially less than the width of the plate 21 and is of sufficient dimension to be inserted into the normal opening 16 of a standard or conventional strike plate 17. The opposite end of the member 21 is provided with a flange 26 outwardly extending from the plate 21 in a similar manner to the extension of tang 25. However, the flange 26 is of the same width as the width of member 21. It is to be emphasized that the slot 23 extends from the upper edge 24 past the center of the plate 21 so that it terminates in spaced relationship with respect to the lower edge identified by numeral 27.

With respect to the latch plate 22, it can be seen that the plate is elongated having a U-shaped cut-out 28 provided adjacent one end thereof which terminates in a semi-circular portion 30. Also, the plate 22 includes a slot 31 opening along the lower or bottom edge 32 of the plate and extending in a vertical direction upwardly to terminate in fixed space relationship with respect to the top or upper edge 33. The slot 31 is located adjacent the end of plate 22 opposite from its end formed with the U-shaped cut-out 28. In use, it is intended that the slots 31 and 23 be superimposed over one another so that the plate 22 will slide downwardly so that its solid section represented by numeral 34 will rest adjacent to a solid section of the base member represented by numeral 35.

Referring now in detail to FIG. 2, the novel and inventive latching device of the present invention is illustrated in a typical application on a closed or shut door. Once the door 10 is in the closed or shut position, the bolt 15 is extended through opening 16 into the door jamb recess identified by numeral 36. Prior to closing the door, the base member 21 has been installed so that the tang 25 partially occupies the recess 36 via insertion through the strike plate opening 16. At this time, the major length of the base member 21 projects outwardly from the surface of the door jamb and the door so that its longitudinal axis is substantially normal to the surface of the door jamb.

Next, the latch plate 22 is installed by aligning the open end of slot 31 with the open end of slot 23 so that the plate 22 moves downwardly whereby the cut-out 28 insertably receives the shaft or shank 13 of the door knob 12. The latch plate 22 will progress until the terminating end of slots 31 and 23 engage with one another. At this time, the semi-circular cut-out 30 will substantially rest atop or near the top of the shaft or shank 13. It can be seen that the main body of the plate 22 resides between the base member 21 and the shank or shaft 13 while a leg portion identified in general by numeral 37 is cantilevered outwardly from the shaft or shank 13 and extends downwardly on the opposite side of the shaft or shank 13 from the major body of the plate 22.

Once the base member 21 and the latch plate 22 have been so assembled with the bolt recess 36, the door knob shaft or shank 13 and with their mated slot arrangement, the door 10 cannot be opened in either direction. The latching apparatus or device of the present invention provides a positive lock which does not require installation employing screws or other fasteners and does not require keys or special locking mechanisms such as an array of tumblers or the like. Also, when it is desired to unlock the door, the latch plate 22 may be manually lifted from its position on the shaft or shank 13 and raised upwardly so that the plate will slide with respect to the member 21 via the interposed slots until the slots are disengaged. At this time, the latch plate is totally removed and the door may be opened.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a door latching apparatus including a door knob with a knob shaft comprising:

an elongated base member having an outwardly projecting tang normal to the longitudinal axis of said base member and a slot provided substantially midway between its opposite ends opening at a top edge of said base member and terminating in fixed spaced apart relationship with respect to a bottom edge so as to define a solid region of said base member therebetween;

an elongated latch plate having a U-shaped cut-out for insertably receiving said door knob adjacent a selected end of said latch plate and formed in a lower edge of said latch plate extending upwardly toward an upper edge thereof;

said latch plate further having a slot provided therein opening at said lower edge and extending upwardly to terminate in fixed spaced apart relationship with respect to said upper edge so as to define a solid region of said latch plate therebetween and whereby said base member slot and said latch plate slot are adapted to be slidably related so as to join said base member and said latch plate together in a right angled relationship;

said base member includes a flange carried on its end opposite to its end carrying said tang which outwardly projects lateral from the longitudinal axis of said base member;

said latch plate slot is provided substantially adjacent to the end of said latch plate from its end provided with said U-shaped cut-out;

said latch plate cut-out terminates in a semi-circular configuration so as to fit with said door knob shaft in conformal relationship;

a strike plate having an opening therein secured to a door jamb;

said door knob including knob shaft carried on a door; and said tang of said base member adapted to be insertably received through said strike plate opening and said U-shaped cut-out adapted to be slidably placed over said door knob shaft so as to secure said door to said door jamb.

* * * * *